US006124874A

United States Patent [19]

Kinjou et al.

[11] Patent Number: 6,124,874

[45] Date of Patent: Sep. 26, 2000

[54] DUST ELIMINATOR AND IMAGE/ INFORMATION RECORDING DEVICE PROVIDED WITH IT

[75] Inventors: Kazuaki Kinjou; Mitsuru Sawano, both of Shizuoka; Hisao Ooishi, Kanagawa, all of Japan

[73] Assignee: Fuji Photo Film Co., Ltd., Kanagawa, Japan

[21] Appl. No.: 09/326,700

[22] Filed: Jun. 7, 1999

[30] Foreign Application Priority Data

Jun. 10, 1998 [JP] Japan ..... 10-162444

[51] Int. Cl.[7] ..... B41J 29/17

[52] U.S. Cl. ..... 347/171

[58] Field of Search ..... 347/171, 218

[56] References Cited

FOREIGN PATENT DOCUMENTS 3-5782 1/1991 Japan .

10-16365 1/1998 Japan .

*Primary Examiner*—Huan Tran

*Attorney, Agent, or Firm*—Sughrue, Mion, Zinn, Macpeak & Seas, PLLC

[57] ABSTRACT

A dust eliminator for removing dust prior to a thermal transfer type recording, in a device such as a thermal or laser printer, using a plurality of rollers which possess varying adhesive strengths. A toner sheet is supplied to a printing surface of a thermal head from a supply roll. The toner sheet comes in contact with an adhering surface of a roller with weak adhesive strength, prior to the thermal head, removing dust from the surface of the toner sheet. The toner sheet then comes into contact with an adhering surface of a roller with strong adhesive strength, removing any remaining dust which did not adhere to the weak adhesive roller. The toner sheet then passes though a clearance between the thermal head and a platen roll and is wound by a toner by a winding roll.

13 Claims, 4 Drawing Sheets

DUST ELIMINATOR AND IMAGE/ INFORMATION RECORDING DEVICE PROVIDED WITH IT

BACKGROUND OF THE INVENTION

1. Field of the Invention

The present invention relates to a dust eliminator for preventing dust from adhering to a sheet and an image/information recording device provided with it.

2. Description of the Related Art

In a printer for recording an image and information using a thermal head, a laser head, or other method, dust adhering to the recording material and other elements may have a serious effect upon the quality of a finished image, particularly a finished color image.

For example, as shown in FIG. 4, in a printer adopting a method of bonding a toner sheet T and an image receiving sheet R, heating them using a laser head or a thermal head and transferring an image generated by heat developing from the toner sheet T onto the image receiving sheet R, if dust X exists between the above toner sheet T and image receiving sheet R, a void in the image is caused in a range shown by an arrow A because of the failure of bonding due to the dust X between the toner sheet T and the image receiving sheet R.

Also, as shown in FIG. 5, in a printer adopting a method of bonding a toner sheet T and an image receiving sheet, pressing them on a recording drum and exposing an image by a laser beam L from the side of the toner sheet T, if a laser beam for recording L is defocused because of the deformation due to the dust X of the image receiving sheet R and the toner sheet T and the displacement in the direction of an optical axis of a photothermal conversion layer in the toner sheet T exceeds an allowable value since dust X exists between the image receiving sheet R and the surface of a recording drum, sufficient energy density cannot be acquired, and the thinning of an image, the deterioration of the density and others are caused in a range shown by an arrow B to be the unevenness of an image.

As another example, as the release of heat from the base material of an image receiving sheet to a recording drum is reduced, the temperature of the respective contact parts between the image receiving sheet and a toner sheet is higher than when no dust X is present and the density of an image may be also increased in the range shown by the arrow B.

In the meantime, as shown in FIG. 6, in a printer adopting a method of bonding a toner sheet T and an image receiving sheet R, heating them using a laser head and transferring an image generated by heat developing from the toner sheet T onto the image receiving sheet R, if dust X exists on the toner sheet T, the energy of a laser beam for recording L is attenuated or intercepted, a portion on which the dust X exists is not recorded, thinning an image, deteriorating the print density and causing unevenness in the rendered image.

Further, as shown in FIG. 7, in a printer adopting a method of bonding a toner sheet T and an image receiving sheet R, heating them using a thermal head and transferring an image generated by heat developing from the toner sheet T onto the image receiving sheet R, if dust X exists on the toner sheet T, quantity in which thermal energy is transmitted from the thermal head TH to a record medium (T and R) is attenuated or intercepted in a portion where the dust X exists, the portion where the dust X exists is not recorded, thinning an image, deteriorating the print density and causing unevenness in the rendered image. An arrow C shows a direction in which the toner sheet T and the image receiving sheet R move relative to the thermal head.

Some of the conventional type printers are provided with an adhesive roller for eliminating dust, which otherwise causes a void and the unevenness of an image, from a sheet before recording inside each printer. Dust which adheres to the surface of a toner sheet or an image receiving sheet is eliminated by touching the adhesive roller to the sheet surface thereby preventing a printing void and the unevenness of an image.

As described above, a void and the unevenness of an image can be prevented by eliminating dust using an adhesive roller. However, in this conventional type printer, as the surface of the adhesive roller fills with dust, the adhesive strength deteriorates and new dust is not eliminated, causing printing errors, imperfections, and failures. When the adhesive strength has deteriorated, dust once eliminated peels from the adhesive roller and dust again adheres to the sheet surface and other elements.

SUMMARY OF THE INVENTION

In view of the above conditions, the object of the present invention is to provide a dust eliminator, where the life of the dust eliminating function is long-lived, thereby preventing failure due to dust within printing and image/information recording devices.

To achieve this objective a dust eliminator is provided which has a plurality of adhesive rollers for eliminating dust adhering to a material, wherein the plurality of adhesive rollers possess different adhesive strengths.

According to the above composition, printing failure due to dust is prevented and the life of the dust eliminating function is extended.

In this invention, a dust eliminator is characterized in that the plurality of adhesive rollers are arranged in order from an adhesive roller, the adhesive strength of which is weak, to an adhesive roller the adhesive strength of which is strong, ordered in a direction in which the material is carried.

According to the above composition, dust adhering to the material can be securely eliminated.

In this invention, a dust eliminator is characterized by the adhesive roller, the adhesive strength of which is weak, touching the material, and the adhesive roller the adhesive strength of which is strong, touching the surface of the adhesive roller with weak adhesive strength.

According to the above composition, dust eliminated by the adhesive roller with weak adhesive strength is transferred to the adhesive roller with strong adhesive strength. Dust once eliminated never again adheres to the material.

In this invention, an image/information recording device is based upon an image/information recording device for recording an image and information on an image receiving sheet using a toner sheet and a recording head and characterized in that the dust eliminator is such as one disclosed in this invention.

In this invention, the image/information recording device is characterized in that the above plural adhesive rollers are arranged so that they come in contact with the surface and/or the back of a toner sheet and/or an image receiving sheet.

According to the composition of this invention, a device with an extended-life dust eliminating function is provided for preventing the failure due to dust in printing.

DESCRIPTION OF THE PREFERRED EMBODIMENTS

Figure 1:
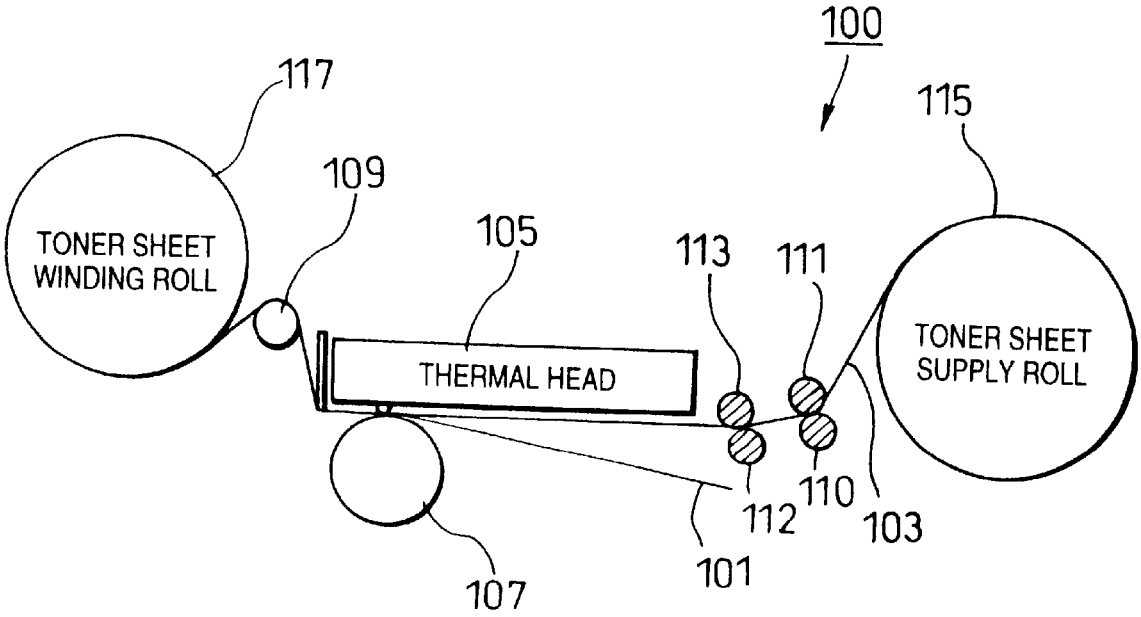
FIG. 1 is a sectional view showing a printer equivalent to a first embodiment of the present invention.

Referring to the drawings, embodiments of the present invention will be described below.

FIG. 1 is a sectional view showing a printer equivalent to a first embodiment of the present invention.

A printer 100 which is an image/information recording device is composed of an image receiving sheet 101 for recording, a toner sheet 103 for transferring an image or information onto the image receiving sheet 101, a thermal head 105 for recording the image or the information onto the image receiving sheet 101 by thermal transfer, a platen roller 107 and a free roller 109, and an adhesive roller the adhesive strength of which is weak 111 (hereinafter called an adhesive roller with weak adhesive strength) which is a dust eliminator for eliminating dust adhering to the toner sheet 103 and an adhesive roller the adhesive strength of which is strong 113 (hereinafter called an adhesive roller with strong adhesive strength) located on the downstream side of the adhesive roller with weak adhesive strength 111 and provided with adhesive strength stronger than the adhesive strength of the adhesive roller with weak adhesive strength 111 are provided to the above printer 100.

Next, the operation of the printer 100 equivalent to this embodiment will be described.

The toner sheet 103 is supplied on the side of the thermal head 105 from a toner sheet supply roll 115 and dust adhering to the surface which comes in contact with the thermal head 105 is eliminated by the adhesive roller with weak adhesive strength 111 touched to the above surface. Some dust cannot be eliminated by the adhesive roller with weak adhesive strength 111. This dust strongly adheres to the material is next eliminated by the adhesive roller with strong adhesive strength 113 located on the downstream side. The toner sheet 103 on which dust is eliminated as described above next passes clearance between the thermal head 105 and the platen roller 107 and is wound by a toner sheet winding roll 117 after thermal transfer.

In the meantime, the image receiving sheet 101 is also simultaneously carried to the clearance between the thermal head 105 and the platen roller 107 with the image receiving sheet overlapping the toner sheet 103. At this time, the thermal head 105 thermically transfers an image or information on the image receiving sheet 101 via the toner sheet 103.

Figure 7:
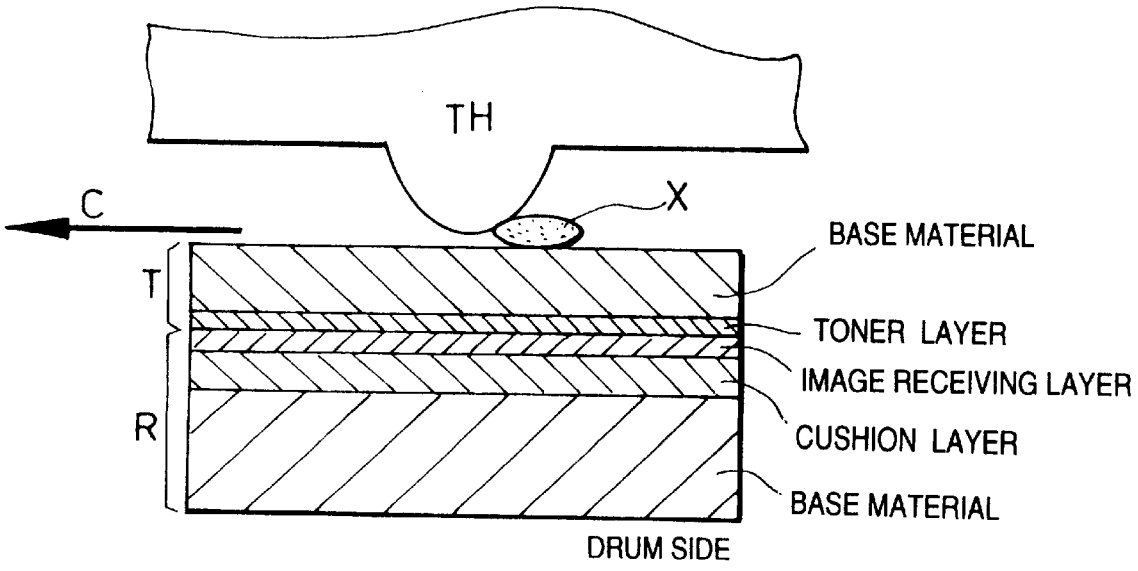
FIG. 7 illustrates the problem of dust on the toner sheet base material of a thermal printer.

In this embodiment, as dust adhering to the surface which comes in contact with the thermal head 105 of the toner sheet 103 is eliminated by the adhesive rollers arranged in the order from the adhesive roller with weak adhesive strength 111 to the adhesive roller with strong adhesive strength 113, a void and the unevenness of an image respectively described in relation to FIG. 7 can be prevented. The reason is that as the adhesive roller with weak adhesive strength 111 eliminates dust which can be readily peeled and the adhesive roller with strong adhesive strength 113 eliminates dust which it is difficult to peel, each adhesive face of the adhesive rollers 111 and 113 can be effectively used. Conversely, as the adhesive roller with strong adhesive strength 113 eliminates any dust adhering to the surface, the succeeding adhesive roller with weak adhesive strength 111 is not required to fulfill a function of eliminating dust if the adhesive rollers are touched to the surface of the toner sheet in order from the adhesive roller with strong adhesive strength 113 to the adhesive roller with weak adhesive strength 111, the meaning of the existence of the adhesive roller with weak adhesive strength 111 is lost. Also, when the surface of the adhesive roller with strong adhesive strength 113 is filled with dust, the adhesive strength is deteriorated and the adhesive roller with strong adhesive strength cannot eliminate dust which is difficult to peel.

Next, a second embodiment of the present invention will be described.

Figure 2:
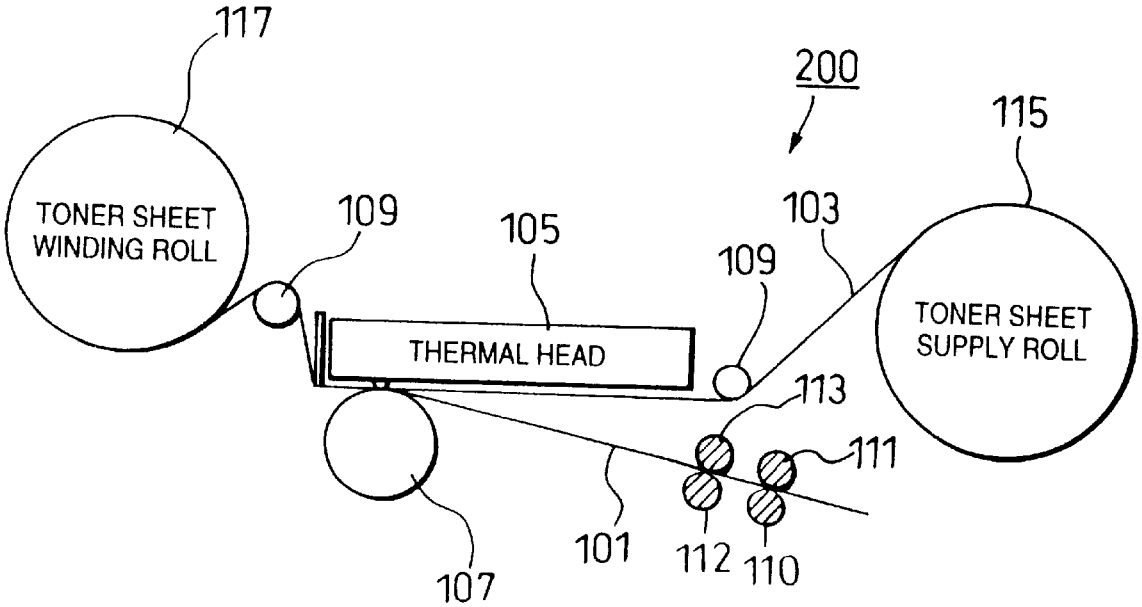
FIG. 2 is a sectional view showing a printer equivalent to a second embodiment of the present invention.

FIG. 2 is a sectional view showing a printer equivalent to this embodiment. However, the same reference number is allocated to the same member as that in the first embodiment.

A printer 200 is composed of an image receiving sheet 101 for recording, a toner sheet 103 for transferring an image or information on the image receiving sheet 101, a thermal head 105 for recording an image or information on the image receiving sheet 101 by thermal transfer, a platen roller 107 and free rollers 109, and an adhesive roller with weak adhesive strength 111 for eliminating dust adhering to the image receiving sheet 101 and an adhesive roller with strong adhesive strength 113 located on the downstream side of the adhesive roller with weak adhesive strength 111 are provided to the above printer 200.

Next, the operation of the printer 200 equivalent to this embodiment will be described.

The toner sheet 103 is supplied on the side of the thermal head 105 from a toner sheet supply roll 115, passes clearance between the thermal head 105 and the platen roller 107 and is wound by a toner sheet winding roll 117.

In the meantime, the image receiving sheet 101 is also simultaneously carried to the clearance between the thermal head 105 and the platen roller 107 with the image receiving sheet overlapping the toner sheet 103. At this time, dust adhering to the recording face of the image receiving sheet is eliminated by the adhesive roller with weak adhesive strength 1II touched to the recording face and next. Dust which is not eliminated by the adhesive roller with weak adhesive strength 111 is eliminated by the adhesive roller with strong adhesive strength 113 touched to the recording face.

The image receiving sheet 101 from which dust is eliminated passes the clearance between the thermal head 105 and the platen roller 107 with the image receiving sheet put between the toner sheet 103 and the platen roller 107. At this time, the thermal head 105 thermically transfers an image or information on the image receiving sheet 101 via the toner sheet 103.

Figure 4:
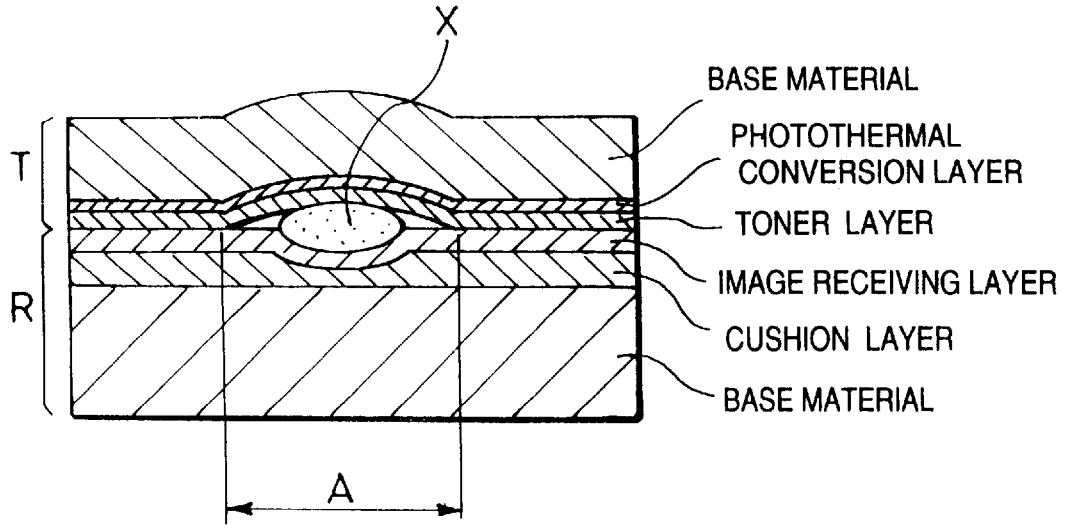
FIG. 4 illustrates the problem of dust between a toner sheet and an image receiving sheet of a thermal transfer printer such as a laser printer [and] or a thermal printer.

In this embodiment, as dust adhering to the recording face of the image receiving sheet 101 is eliminated by the adhesive rollers arranged in order from the adhesive roller with weak adhesive strength 111 to the adhesive roll with strong adhesive strength 113, a void and the unevenness of an image respectively described in relation to FIG. 4 can be prevented. The reason is that as the adhesive roller with weak adhesive strength 111 eliminates dust which can be readily peeled and the adhesive roller with strong adhesive strength 113 eliminates dust which it is difficult to peel, the respective adhesive faces of the adhesive rollers 111 and 113 can be effectively used. Conversely, as the adhesive roller with strong adhesive strength 113 eliminates any dust adhering to the recording face and the succeeding adhesive roller with weak adhesive strength 111 is not required to fulfill a function of eliminating dust if the adhesive rollers are touched to the above recording face in order from the adhesive roller with strong adhesive strength 113 to the adhesive roller with weak adhesive strength 111, the meaning of the existence of the adhesive roller with weak adhesive strength 111 is lost. When the surface of the adhesive roller with strong adhesive strength 113 is filled with dust, the adhesive strength deteriorates and the adhesive roller with strong adhesive strength cannot eliminate dust which is difficult to peel.

Next, a third embodiment of the present invention will be described.

Figure 3:
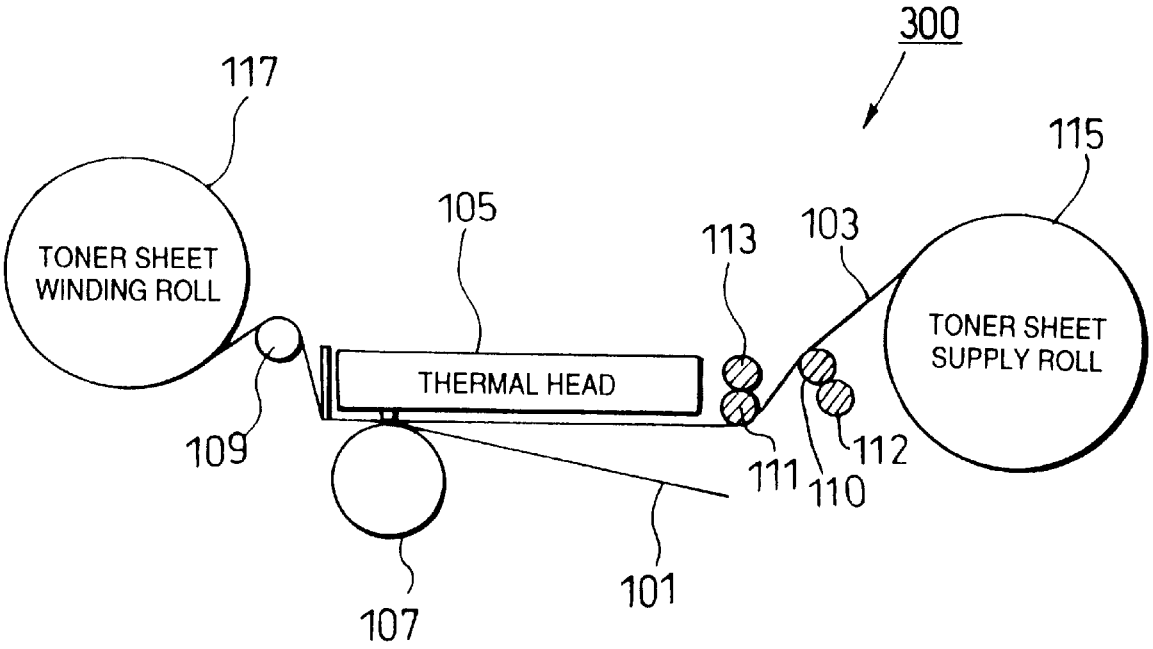
FIG. 3 is a sectional view showing a printer equivalent to a third embodiment of the present invention.

FIG. 3 is a sectional view showing a printer equivalent to this embodiment. However, the same reference number is allocated to the same member as that in the first and second embodiments.

A printer 300 is composed of an image receiving sheet 101 for recording, a toner sheet 103 for transferring an image or information on the image receiving sheet 101, a thermal head 105 for recording an image or information on the image receiving sheet 101 by thermal transfer, a platen roller 107 and a free roller 109, and an adhesive roller with weak adhesive strength 111 for eliminating dust adhering to the toner sheet 103 and an adhesive roller with strong adhesive strength 113 touched to the surface of the adhesive roller with weak adhesive strength 111 for further eliminating dust eliminated from the toner sheet 103 by the adhesive roller with weak adhesive strength 111 are provided to the above printer 300.

Next, the operation of the printer 300 equivalent to this embodiment will be described.

The toner sheet 103 is supplied on the side of the thermal head 105 from a toner sheet supply roller 115 and dust adhering to the surface which comes in contact with the thermal head 105 of the toner sheet is eliminated by the adhesive roller with weak adhesive strength 111 touched to the above surface. The dust eliminated by the adhesive roller with weak adhesive strength 111 is eliminated from the adhesive roller with weak adhesive strength 111 by the adhesive roller with strong adhesive strength 113 arranged so that the adhesive roller with strong adhesive strength 113 comes in contact with the adhesive roller with weak adhesive strength 111 soon afterward. The toner sheet 103 from which dust is eliminated next passes clearance between thermal head 105 and the platen roller 107 and is wound by a toner sheet winding roll 117.

In the meantime, the image receiving sheet is also simultaneously carried to the clearance between the thermal head 105 and the platen roller 107 with the image receiving sheet overlapped with the toner sheet 103. At this time, the thermal head 105 thermically transfers an image or information on the image receiving sheet 101 via the toner sheet 103.

In this embodiment, as dust adhering to the surface which comes in contact with the thermal head 105 of the toner sheet 103 is eliminated by the adhesive roller with weak adhesive strength 111, a void and the unevenness of an image can be prevented. Also, as dust eliminated by the adhesive roller with weak adhesive strength 111 is eliminated by the adhesive roller with strong adhesive strength 113, the deterioration of a dust eliminating function due to the deterioration of the adhesive strength caused because dust accumulates on the surface of the adhesive roller with weak adhesive strength 111 can be prevented. This helps to extend the life of the dust eliminating function.

In the above first to third embodiments, the examples that the adhesive rollers 111 and 113 are arranged on only the single side of the toner sheet 103 or the image receiving sheet 101 are described. However, the present invention is naturally not limited to these and as further embodiments the adhesive rollers may be also arranged on the reverse side of the toner sheet 103 or the image receiving sheet 101; that is, on the side of the surface which comes in contact with the image receiving sheet 101 of the toner sheet 103 or on the side of the surface which comes in contact with the platen rollers 107 of the image receiving sheet 101. Such embodiments are illustrated in FIGS. 1–3, in which an adhesive roller with weak strength 110 and an adhesive roller with strong adhesive strength 112 are touched to a respective back surface.

A dust eliminator wherein the first to third embodiments are combined is also considered. That is, the adhesive roller with weak adhesive strength 111 and the adhesive roller with strong adhesive strength 113 are respectively touched on both surfaces of the toner sheet 103 and the image receiving sheet 101, and it is desirable that an adhesive [roll] roller with stronger adhesive strength is touched to the adhesive roller with strong adhesive strength 113 and the adhesive roller with strong adhesive strength 113 is touched to the adhesive roller with weak adhesive strength 111.

Figure 5:
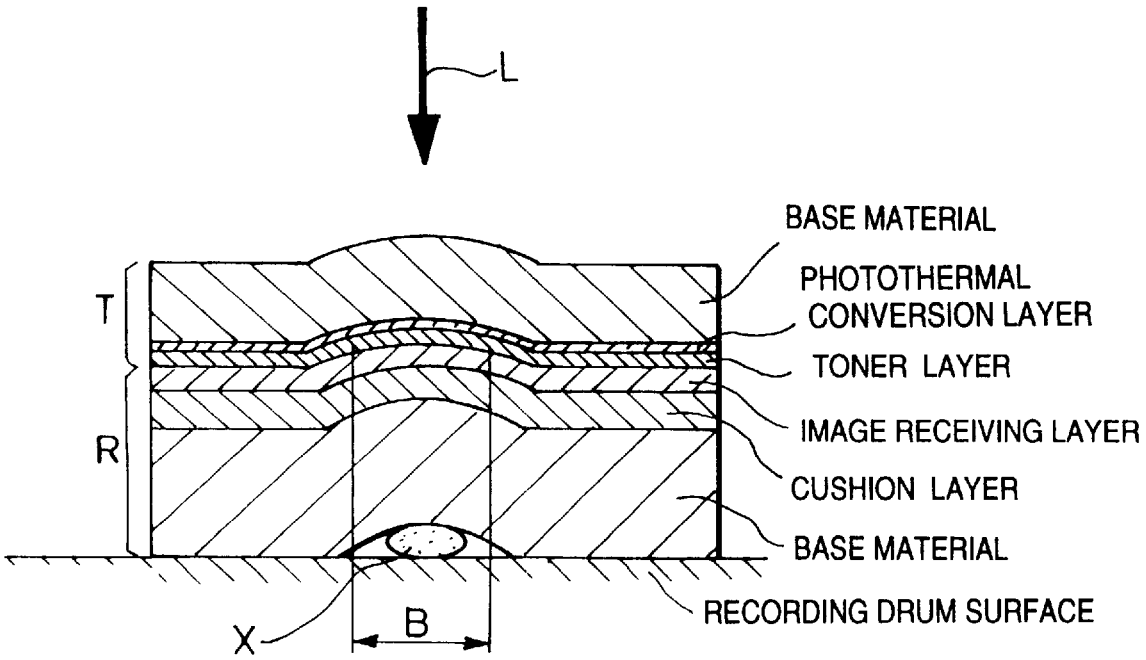
FIG. 5 illustrates the problem of dust on a recording drum of a laser printer.
Figure 6:
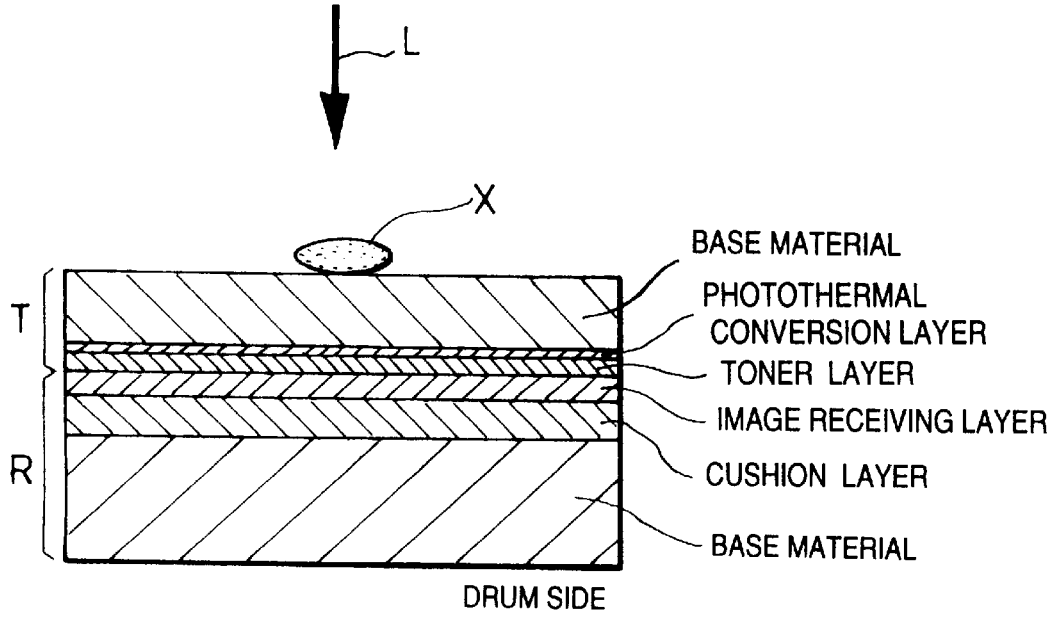
FIG. 6 illustrates the problem of dust on the toner sheet base material of a laser printer.

Also, in the above first to third embodiments, the printer using the thermal head 105 is described. However, the present invention is not limited to this and it need scarcely be said that the present invention is also applied to a printer using a laser head. Hereby, the problem of dust on the laser printer described in relation to FIGS. 5 and 6 is solved.

As described above, according to the present invention, the image/information recording device incorporating the dust eliminator includes the plurality of adhesive rollers of different adhesive strengths, the effect of which is that printing failure due to dust is prevented and the life of the dust eliminating function is extended.

What is claimed is:

1. A dust eliminator for removing dust adhering to a material, comprising:

a first adhesive roller, having a first adhesive strength; and a second adhesive roller, having a second adhesive strength;

wherein the second adhesive strength is stronger than the first adhesive strength; and wherein the first and second adhesive rollers are arranged in order from said first adhesive roller to said second adhesive roller in a direction in which the material is carried.

2. A dust eliminator according to claim 1, wherein:

said first adhesive roller touches the material; and said second adhesive roller touches a surface of said first adhesive roller.

3. A dust eliminator according to claim 1, wherein:

said dust eliminator is incorporated with an image/information recording device for recording an image or information on an image receiving sheet using a toner sheet and a recording head.

4. A dust eliminator according to claim 3, wherein:

the first and second adhesive rollers are arranged so that at least one roller of the first and second adhesive rollers touches at least one of a surface or a back of the toner sheet or the image receiving sheet.

5. A dust eliminator according to claim 3, wherein:

the first and second adhesive rollers are arranged on a side of the image receiving sheet that does not face the toner sheet;

the first and second adhesive rollers touch the image receiving sheet; and the first and second adhesive rollers are arranged in order from said first adhesive roller to said second adhesive roller in a direction in which the image receiving sheet is carried.

6. A dust eliminator according to claim 5, further comprising:

a third adhesive roller, having a third adhesive strength; and a fourth adhesive roller, having a fourth adhesive strength; wherein:

the fourth adhesive strength is stronger than the third adhesive strength;

the third and fourth adhesive rollers are arranged on a side of the image receiving sheet that faces the toner sheet;

the third and fourth adhesive rollers touch the image receiving sheet; and the third and fourth adhesive rollers are arranged in order from said third adhesive roller to said fourth adhesive roller in a direction in which the image receiving sheet is carried.

7. A dust eliminator according to claim 3, wherein:

the first and second adhesive rollers are arranged on a side of the image receiving sheet that faces the toner sheet;

the first and second adhesive rollers touch the image receiving sheet; and the first and second adhesive rollers are arranged in order from said first adhesive roller to said second adhesive roller in a direction in which the image receiving sheet is carried.

8. A dust eliminator according to claim 3, wherein:

the first and second adhesive rollers are arranged on a side of the toner sheet that does not face the image receiving sheet;

the first and second adhesive rollers touch the toner sheet; and the first and second adhesive rollers are arranged in order from said first adhesive roller to said second adhesive roller in a direction in which the toner sheet is carried.

9. A dust eliminator according to claim 8, further comprising:

a third adhesive roller, having a third adhesive strength; and a fourth adhesive roller, having a fourth adhesive strength; wherein:

the fourth adhesive strength is stronger than the third adhesive strength;

the third and fourth adhesive rollers are arranged on a side of the toner sheet that faces the image receiving sheet;

the third and fourth adhesive rollers touch the toner sheet; and the third and fourth adhesive rollers are arranged in order from said third adhesive roller to said fourth adhesive roller in a direction in which the toner sheet is carried.

10. A dust eliminator according to claim 3, wherein:

the first and second adhesive rollers are arranged on a side of the toner sheet that faces the image receiving sheet;

the first and second adhesive rollers touch the toner sheet; and the first and second adhesive rollers are arranged in order from said first adhesive roller to said second adhesive roller in a direction in which the toner sheet is carried.

11. A dust eliminator according to claim 1, wherein:

said first adhesive roller touches the material; and a third adhesive roller, having an adhesive strength stronger than the first adhesive strength, touches a surface of said first adhesive roller.

12. A dust eliminator according to claim 11, wherein:

said second adhesive roller touches the material; and a fourth adhesive roller, having an adhesive strength stronger than the second adhesive strength, touches a surface of said second adhesive roller.

13. A dust eliminator according to claim 1, further comprising:

said second adhesive roller touches the material; and a third adhesive roller, having an adhesive strength stronger than the second adhesive strength, touches a surface of said second adhesive roller.

* * * * *